United States Patent [19]

Smith et al.

[11] Patent Number: 4,956,573

[45] Date of Patent: Sep. 11, 1990

[54] GAS DISCHARGE DISPLAY DEVICE WITH INTEGRAL, CO-PLANAR, BUILT-IN HEATER

[75] Inventors: Paul H. Smith, La Habra; Lee R. Wood, Downey; Elias J. Lara, Lake Elsinore, all of Calif.

[73] Assignee: Babcock Display Products, Inc., Anaheim, Calif.

[21] Appl. No.: 286,138

[22] Filed: Dec. 19, 1988

[51] Int. Cl.[5] ..... H01J 61/24; H01J 7/24

[52] U.S. Cl. ..... 313/15; 313/518; 313/519

[58] Field of Search ..... 313/519, 518, 15

[56] References Cited

U.S. PATENT DOCUMENTS

| | | | |
|---|---|---|---|
| 4,446,400 | 5/1984 | Cherry | 313/519 X |
| 4,520,290 | 5/1985 | Cokefair | 313/519 X |
| 4,692,655 | 9/1987 | Person et al. | 313/519 X |
| 4,730,139 | 3/1988 | Harvey | 313/15 |
| 4,746,838 | 5/1988 | Kay | 313/519 |

*Primary Examiner*—Palmer C. DeMeo

*Attorney, Agent, or Firm*—G. Donald Weber, Jr.

[57] ABSTRACT

A gas discharge display which includes a heater element that is built into the unit. The heater element is co-planar with the cathode electrodes of the display. A single set of parallel conductive pins is used to provide the connections for the anode, cathode and heater element components of the display.

10 Claims, 1 Drawing Sheet

GAS DISCHARGE DISPLAY DEVICE WITH INTEGRAL, CO-PLANAR, BUILT-IN HEATER

BACKGROUND OF THE INVENTION

1. Field of the Invention

This invention relates to display devices, in general. In particular, the invention relates to alpha-numeric gas discharge displays which include a built-in-heater so that the display may be used in locations exposed to cold temperatures, for example, in gasoline pumps. More particularly, the heater is co-planar with the cathode electrodes, is easily adjusted for electrical resistance by selectively severing portions of the heater and is protected from inadvertent reconnection of the severed sections of the heater as a result of electrical shorting by condensed mercury, for example.

2. Prior Art

A typical gas discharge display device includes a chamber in which there is sealed an inert gas such as neon argon, or a mixture thereof. Of course, other inert gases can be used as desired. The gas in the chamber is, generally, maintained at sub-atmospheric pressure. Mercury vapor is often included within this chamber to impede ions of the gas from bombarding the cathode electrode while the display device is activated. However, mercury vapor tends to condense at about 0° C. Thus, in applications where the gas discharge display device is cooled to temperatures at or below 0° C., condensed mercury tends to settle onto the cathode electrode, as well as any other electrodes in this plane. The display device usually produces enough heat to maintain the mercury in the vaporized state during normal display operation. However, condensation of the mercury occurs when the display is turned off in a cold environment.

The condensed mercury tends to create a lump on the surface of the cathode electrode. The lump decreases the distance between the anode and cathode electrodes. This decrease in distance causes more current through that "hot spot" and produces a bright spot in the display. Furthermore, the increased current often causes the mercury to splatter throughout the chamber. When the mercury is splattered onto the anode electrode, a black spot can be created in the display.

Furthermore, it is possible for the mercury to solidify on the cathode electrode. A build-up of mercury can cause an arc discharge in the display device rather than the normal glow discharge.

Also, the condensation of mercury dictates that there will be less mercury vapor in the chamber to hinder the ion bombardment of the cathode electrode. The resultant increase in ion bombardment decreases the life span of the cathode electrode, thereby reducing the useful life of the display device.

Last, but not least the condensed mercury can also cause shorting between electrodes in the display device. For example, in some cases a selectively disconnected electrode is undesirably re-connected by the condensed mercury. As a result, certain characteristics of the display device are altered in an unexpected and uncontrolled fashion.

To eliminate these problems when the ambient temperature is below the condensation point of the mercury, it is necessary and/or desirable to heat the gas discharge display device prior to activation.

In the past, one approach has been to include an external heating unit behind (i.e. on the back of) the display device. The external heating unit is normally connected to a separate power source. In cold weather, prior to switching on the gas discharge display device, the heating unit is turned on. However, in order to be efficient, the heating unit must be in intimate contact with the display and insulated from the surrounding environment to minimize heat loss. Also, where the gas discharge display is used in a gasoline pump, exposure to gasoline fumes can be undesirable for the heater unit because of the high temperatures and the possibility of combustion.

In another approach, the heater has been built into the display (see for example, U.S. Pat. No. 4,520,290; Cokefair). However, this approach requires a heater element disposed on an inner surface of the display chamber, an insulating layer disposed on the heater element, and a cathode layer disposed on the insulating layer. This approach has severe drawbacks in that at least two additional process steps are required in the production of the display device. The additional process steps also tend to alter the operating characteristics of the heater element which has been tailored for resistance levels prior to the process steps. Consequently, the heater operation is subject to uncontrolled modification. Moreover, because of the extra layer of insulation between the heater element and the cathode electrode layer, problems with cracking frequently occur as a result of the cyclic heating/cooling operations. Also, each successive layer increases the probability of an interelectrode short circuit developing. Likewise, pinhole defects in the insulating layer are not easily detected when sandwiched between two conductors.

Another prior art device is taught by Person et al. in U.S. Pat. No. 4,692,655. This device uses a heater element which is printed on the same substrate surface of the display device as the cathode electrodes. The cathodes and the heater element can be printed at the same time. However, the heater element includes a plurality of "rung connectors" in a ladder-like conductor arrangement. Each of these "rung-connectors" includes a small break which can be selectively shorted by the subsequent application of a drop of conductor ink. This permits the selective alteration of the resistance of the heater element.

Unfortunately, this arrangement requires the heater element to be measured and finalized prior to a plurality of additional processing steps in the fabrication of the display device.

These steps include deposition steps, firing steps and the like which tend to alter the characteristics of the heater element after it has been finalized. Thus, the heater element is subject to a number of uncontrollable, unpredictable and irreversible alterations and variations of its operating characteristics. These alterations are of the type experienced with the Cokefair device noted supra.

Other shortcomings of prior art display devices are known to those skilled in the art. These shortcomings need to be overcome in order to produce a useful, efficient gas discharge display device capable of low temperature operation.

PRIOR ART STATEMENT

A list of patents discovered during a search is provided herewith. The patents are listed in numerical order with no emphasis or special ranking thereof.

U.S. Pat. No. 3,206,638; MEMORY FOR X-Y PLOTTER; Moore. This patent is directed to an X-Y plotting device, and the memory therefor which includes a plurality of electrodes arranged with respect to holes in the surface thereof with resistors connected between certain electrodes and certain apertures.

U.S. Pat. No. 3,749,969; GAS DISCHARGE DISPLAY APPARATUS; Miyashiro et al. This patent is directed to a gas discharge display apparatus of typical configuration with certain additional attributes to enhance the operation thereof.

U.S. Pat. No. 4,080,545; SODIUM VAPOR LAMP WITH EMISSION APERTURE; Gallo. This invention is directed to a sodium vapor lamp which includes a discharge tube which is heated at the aperture through which light emission is desired by means of ohmic heating of a conductive film such as tin oxide or fine wires.

U.S. Pat. No. 4,156,164; DISPLAY DEVICE USING HOT CATHODE GAS DISCHARGE; Yamagami et al. This patent is directed to a D.C. gas discharge display device which includes hot cathodes which are part of a thermal electron generating space in the display.

U.S. Pat. No. 4,500,878; THERMO ELECTRICALLY CONTROLLED ELECTROCHROMATIC VISUALIZATION DEVICE; Hareng et al. This patent is directed to an electrically controlled display or visualization device specifically using an electrochromatic material placed between first and second electrodes and including the concept of passing an electric heating current through one of said electrodes.

U.S. Pat. No. 4,520,290; GAS DISCHARGE DISPLAY WITH BUILT-IN HEATER; Cokefair. This patent is directed to a gas discharge display which includes a heater which is built into the unit and has a single set of parallel conductive pins for providing connections to the cathode, anode and heater strip of the display unit. An insulator layer is disposed between the heater strip and the cathode layer.

U.S. Pat. No. 4,692,655; PLASMA DISPLAY HAVING HEATER AND METHOD OF MAKING SAME; Person et al. This patent is directed to a gas discharge display device which includes a resistance heater element on an inner surface of one substrate of the display device. The heater element is altered by additive operations.

Japanese Patent No. 54-119897; LIQUID CRYSTAL DISPLAY UNIT; Nippon Denso et al. This patent is directed to a liquid crystal display which utilizes the heating of the unit by detecting the delay in the response time caused at low temperatures. A separate heating panel is used with the device.

Japanese Patent No. 54-122238; WARMING TYPE DISPLAY DEVICE; Nippon Denso. This invention is directed to a liquid crystal display device which includes a heating element therein to provide for cold weather operation. In particular, the reflecting plate of the LCD body serves as a heating element when the liquid crystal material does not operate normally.

Russian Patent No. 0849288; DISPLAY DEVICE; Morozov et al. This invention is directed to a nonvolatile data display device which uses heaters on the side walls and switching plates with protrusions for providing mechanical indication. In particular, the original form of the segments is restored by actuating the heaters through push button springs.

SUMMARY OF THE INVENTION

This invention is directed to a gas discharge display unit with a built-in heater element. A sealed gas chamber is formed between two layers of glass. The anode and cathode terminals are disposed on opposite sides of the chamber. A heater element is located between the glass layers and is co-planar with the cathode terminal on one of the glass layers. The heater element is electrically insulated from the anode and cathode electrodes, as well as the other components of the display unit. External electrical connections are provided to the electrodes and to the heater element.

According to a preferred embodiment of the invention, the electrically conductive connectors for the electrodes and the heater strips are arranged in parallel along one edge of the display unit. This provides the advantage of easy connection to a power source for the control of the display and the heater element. Because of the proximity of the heater element to the cathode terminal, the heating of the cathode terminal and the gas chamber is more efficient than if the heater element is external to the unit.

A significant advantage of this invention is the economy obtained in fabricating a display device wherein the heater element and the cathode terminal are created at the same time, in the same fabrication step, using the same materials and the same mask, and requiring only one layer. The use of a single mask has the added advantage of reducing registration problems, thickness of the display and the like. A dielectric layer is placed over and between the heater element and the cathode terminals. Openings are provided in the dielectric layer at the individual cathode terminal segments and at specific locations over the heater element. Thus, the heater can be tested and accurately trimmed to form an accurate heater resistance which is not subject to subsequent process induced alterations. A sealing material is disposed around the perephey of the substrates and at the aperatures over the heater elements to provide an electrically insulating seal member.

Consequently, it is an object of this present invention to provide a gas discharge display device with a built-in heater with greater reliability, greater accuracy easier production and the like. Moreover, since the heater is within the display unit, the resulting product is more economical, more efficient and easier to connect to a power source.

DETAILED DESCRIPTION OF THE PREFERRED EMBODIMENT

Figure 1:
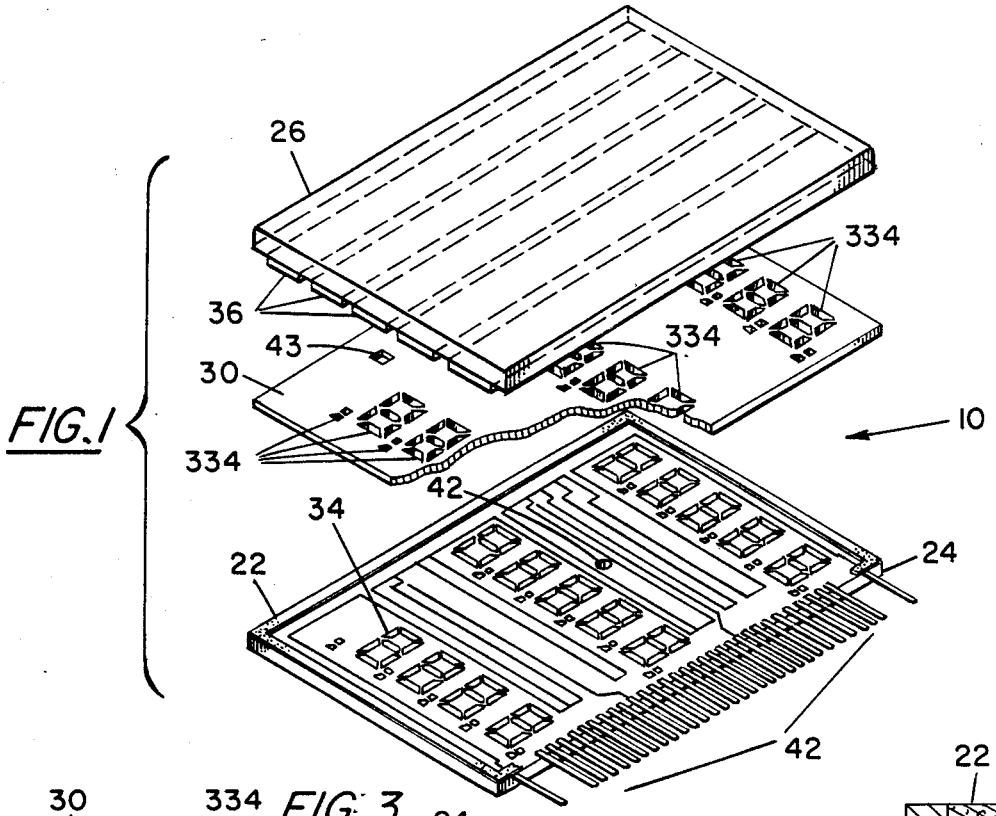
FIG. 1 is an exploded view of a gas discharge display device of the present invention with a built-in heater which is co-planar with the cathode and includes an apertured dielectric layer.
Figure 3:
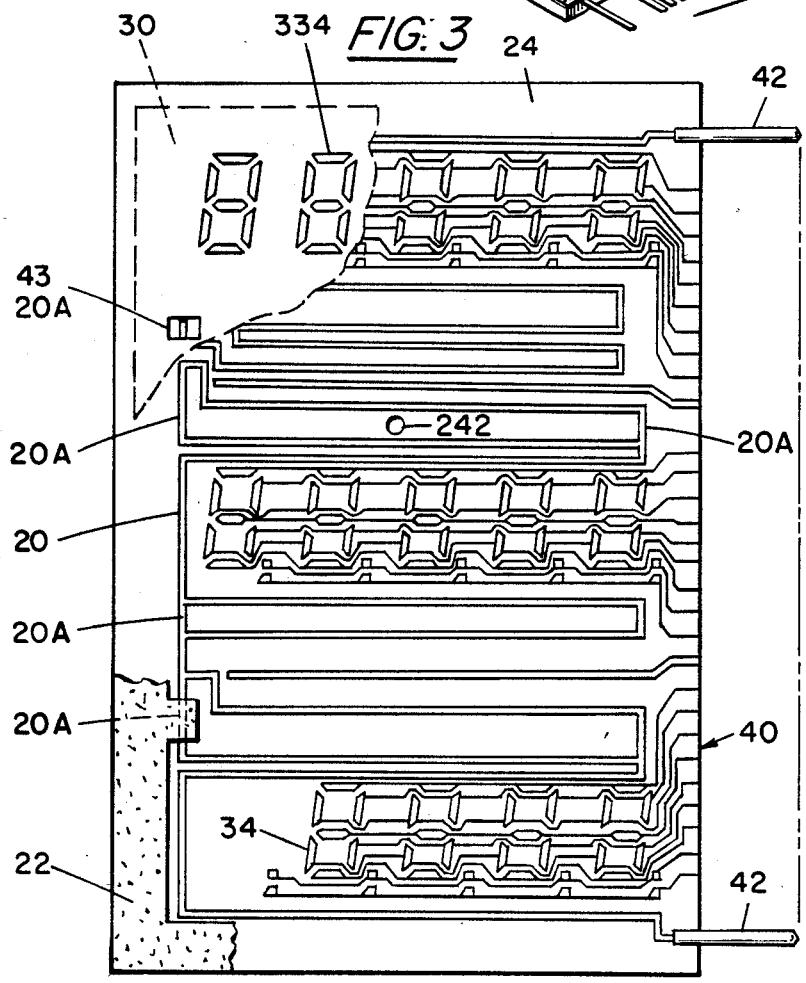
FIG. 3 is a plan view of the cathode electrode and heater element pattern formed on one glass plate of the gas discharge display device partially covered by the apertured dielectric layer and a sealant as shown in FIGS. 1 and 2.
Figure 2:
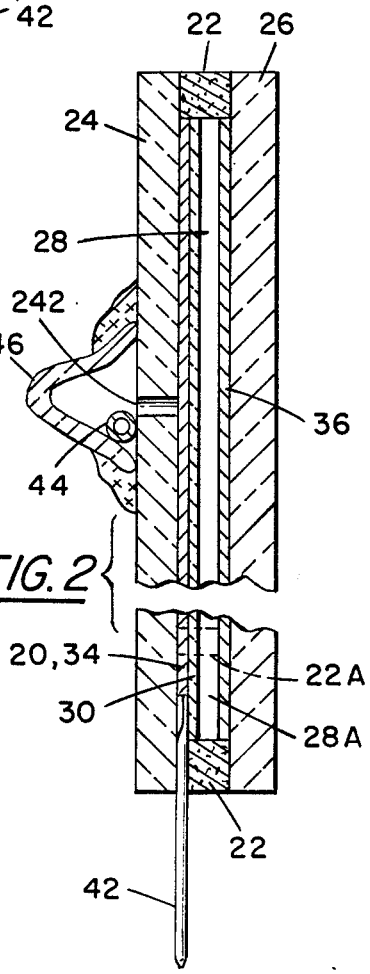
FIG. 2 is a side view of the gas discharge display device of FIG. 1.

Referring now to the FIGS. 1 through 3, the present invention comprises a gas discharge display device 10 with a heater element therein. The display 10 is of, generally, conventional design and includes two layers of glass 24 and 26 which are sealed together by a suitable adhesive 22 to form a hermetically sealed gas chamber 28. Typically, the sealant comprises a perimeter strip 22 formed of glass frit or the like. The heater element 20 is disposed on the inside face of the of glass layer 24 concurrent with the cathode layer 34. The cathode layer 34 comprises a plurality of individual segments arranged in a predetermined pattern. Typically, these materials may be screened onto glass plate 24 in a conventional manner. A dielectric layer 30 is provided to fill the spaces between the heater element 20 and the cathode layer 34 and electrically insulates the heater element 20 from the cathode layer 34. Thus, the dielectric layer 30 prevents any interference between the heater element 20 and any part of the cathode layer 34.

The dielectric layer 30 also includes appropriate openings 334 which are located immediately above the segments of the cathode layer 34. In addition, dielectric layer 30 includes a plurality of trim openings 43. The trim openings 43 are disposed above trim portions 20A of the heater element 20 and are, generally, adjacent to the perimeter of the display device 10.

Opposing the cathode layer 34, and within the chamber 28, is an anode layer 36 which is disposed on the inside face of glass layer 26 in a conventional manner. The anode layer 36 is comprised of a plurality of relatively large electrodes, each of which is arranged with respect to a plurality of segments of the cathode layer 34. Thus, a single electrode of the anode layer 36 is associated with a plurality of segments of the cathode layer 34.

A series of electrically conductive contacts 40 are screen printed along one edge of the display unit. The contacts 40 are connected to the cathode segments 34, the anode electrodes 36 and the heater element 20, respectively. The contacts 40 are connected to terminals 42 which are adapted to plug into an electronic controller apparatus (not shown) for controlling the various electrodes and the heater element.

The cathode layer 34 causes the display device to produce alpha-numeric images by selectively activating one or more of the cathode segments in accordance with a conventional control code signal applied to the terminals 42. In FIG. 1, the cathode layer has seven separate segments arranged in the shape of a figure 8. This cathode configuration can form any of the numerical digits 0 through 9. Other configurations of elements may be used so that the alphabet or other characters may be displayed on the unit.

Although co-planar therewith, the heater element 20 is spatially separated from the segments of cathode layer 34. In a preferred embodiment, heater element 20 is also separated from the segments of cathode layer 34 by the interstitial dielectric layer 30. The resulting proximity of the heater element 20 to the cathode layer permits efficient heating for the cathode layer 34, as well as for the chamber 28.

In a typical fashion, the manufacture of a gas discharge display of the present invention begins with the careful preparation of the glass layers. Typically, the glass layers are made from ordinary soda lime window glass. A small hole 242 is drilled or otherwise made through the first layer of glass 24 which is, generally, referred to as the substrate. The hole 242 will be used subsequently in the manufacturing process to provide access to the sealed chamber 28.

Layers of conductive and insulating material are screened, printed or otherwise disposed on the respective layers of glass. In this invention, the heater element 20 and the cathode terminal layer 34 are screen printed onto the first layer of glass 24 concurrently. Preferably, an electrically conductive nickel material is used in this operation. (Frequently, this type of material is not conductive until "fired" at a prescribed temperature.) The heater element 20 is formed on the substrate 24 adjacent to and interspersed with the segments of cathode layer 34 such that most of the heat generated by the heater element 34 will substantially surround and engulf the cathode layer segments.

The heater element 20 includes at least a portion thereof which extends to the edge of the display unit for making electrical contact with the terminals 42. The cathode layer 34 is laid out in a configuration which permits production of the desired display. Each segment of the cathode layer 34 is connected by a line of conductive material to the edge of the glass layer for connection to one of the electrically conductive contacts 40. The screened-on material of heater element 20 and cathode layer 34 is permitted to dry but is not yet fired.

A dielectric layer 30 for electrically insulating the heater element 20 from the cathode terminal 34 and, as well, from the other portions of the display, is placed over the heater element 20 and the cathode layer 34, for example, by screening. Of course, the layer 30 includes openings 334 and 43 which overlie the cathode segments 34 and portions of heater element 20, respectively. Typically, electrically insulating glass is used as the material dielectric for dielectric layer 30. The insulating material is preferrably opaque, e.g. glass dyed black, in order to avoid disruption of the visual display by stray light or the like.

The dielectric layer 30 is, typically, screened onto the glass 24 and allowed to dry in place in accordance with a suitable temperature profile. However, this dielectric layer 30 is not fired. Thus, the device 10 is not subjected to a high characteristic altering temperature.

The anode layer 36 is deposited onto the second layer of glass 26, which is, generally, referred to as the faceplate. The anode layer 36 is transparent so that the glow of the gaseous medium which is activated by the selective energizing of the segments of cathode layer 34 may be seen therethrough. Typically, a thin layer of indium tin oxide (ITO) is used for the anode layer 36. The anode layer also has at least one portion which extends to the edge of the display for making connection with one or more of the contacts 40. Thus, the connections for the heater element 20, cathode layer 34 and anode layer 36 are all disposed, preferably, along the same edge of the display device although other arrangements are contemplated.

In a conventional arrangement, a pellet 44 containing mercury is placed within a bell-shaped glass tubulation 46. The tube 46 is cemented over the hole 42 in the glass layer 24. Typically, glass frit is used as the adhesive material. The mercury is released into the chamber 28 later in the fabrication process. Alternative methods or techniques can be used for supplying the mercury.

The two layers of glass 24 and 26 (i.e., substrate and faceplate respectively) are sealed together around the edge of the display. Solder glass (or glass frit) is used to form the seal 22. Small beads or pillars of glass can be disposed around the chamber to maintain a separation of about 0.02 inch between the layers of glass. At a minimum, these pillars are formed in the openings 43 in dielectric layer 30. As seen in FIG. 2, the seal 22 substantially surrounds the terminals 42 to complete a hermetic chamber seal. The seal 22 can be a single layer of frit screened onto substrate 24 alone or in conjunction with a layer of frit screened onto faceplate 24.

By placing frit through openings 43, the heater element links 20A are covered by frit. Thus, any links which have been severed, as discussed infra, have frit inserted between the disconnected ends. This arrangement insulates the conductor ends and prevents inadvertent shorting therebetween by arcing or by condensed mercury in the display. Moreover, a single firing simultaneously seals the display device and "sets" the heater element resistance in accordance with prior testing.

A vacuum source is connected to the chamber 28 between the layers of glass via suitable tubulation 46 and hole 242. The pressure within the chamber 28 is reduced to about $10^{-6}$ atmospheres. Gas at about 0.4 atmosphere is then injected into the chamber through the tubulation 46. Typically, the composition of the gas is 99.5% neon and 0.5% argon. The tubulation 46 is sealed to prevent the contents of the chamber 28 from escaping. The mercury in pellet 44 is then released into the sealed chamber 28, for example, by applying a laser beam, RF radiation or the like.

Electrically conductive terminals 42, of suitable material, are attached to the terminal connections 40 for the cathode layer 34, anode layer 36 and heater element 20 in any suitable fashion thereby completing the manufacture of the unit. One type of connection is described in the co-pending application bearing Ser. No. 938,428, now U.S. Pat. No. 4,763,223, entitled NON-SOLDERED LEAD APPARATUS AND METHOD THEREFOR by Sang Tang, and assigned to the common Assignee.

Moreover, as suggested in FIG. 2, an additional sealing strip 22A can be provided in order to define a subchamber 289A which is also hermetically sealed. In this case, all of the trim links 20A can be disposed in the subchamber 28A for ease in accessibility for the trimming or severing operation. Of course, the sub-chamber 28A can be placed on any of the four edges or sides of the display device 10.

As seen best in FIG. 3, the heater element 20 comprises a generally serpentine path configuration which is disposed around the several portions of layer which includes the the cathode terminal 34. In particular, the heater element 20 includes a number of parallel legs or runs interposed between the banks or rows of the segment groups of cathode layer 34. These parallel runs are also interconnected by at least one common connector line. The common connector line is arranged to have the opposite ends 42 thereof available at the the edge of the display for receiving electrical power to energize the heater element.

In addition, it is seen that several of the parallel runs are connected together at the ends thereof by short links 20A. This configuration, including the links 20A, is the pattern which is originally placed on the substrate 24 along with the cathode terminal layer 34 pattern. Moreover, the links 20A are disposed generally adjacent to the perimeter of the unit and beneath the openings 43 in the dry dielectric layer 30. Thus, the links 20A are readily accessible for severing through the openings 43, if so desired.

By selectively breaking the links 20A, by etching, scraping, laser cutting or the like, through the openings 43 the effective length of the heater element 20 can be altered. Thus, the effective resistance of the heater element 20 can be selectively controlled. That is, by permitting a pair of parallel runs to remain connected together, the heater element resistance is effectively reduced between the ends thereof. On the other hand, by selectively breaking a link 20A (otherwise referred to as "trimming"), the effective length of the heater element 20 (and the resistance thereof) is effectively increased. Also, the actual resistance of the heater element 20 can be accurately measured and adjusted.

Moreover, the sealant 22 is applied through the openings 43 and the space between the severed ends of the heater element. This prevents the inadvertent re-connection thereof by, inter alia, condensed mercury or the like.

By using this technique, it is somewhat easier to select the composition of the material to be used in the concurrently applied cathode layer 34 and the heater element 20. That is, a suitable composition of nickel material with a binder (or more generally, a composite of metallic and non-metallic materials) can be selected. The ratio of these materials is significant in controlling the resistivity of the material (and, thus, the resistance of the heater element 20). Of course, so long as the material is electrically conductive, the cathode layer 34 will operate in conjunction with the anode layer 36 so as to produce an electric field therebetween and across the display device chamber 28.

Thus, after the resistivity characteristics of the material have been determined, the configuration of the heater element 20 in terms of convolutions, thickness, width, length and the like are determined. Of course, the relationships can be determined in the reverse order. That is, the particular display configuration may constrain the number or length of heater element runs. In this case, the resistivity parameters may be determinative. In either event, the actual resistance can be accurately monitored in the assembled device because of the absence of multiple firings of the display device during manufacture.

Very importantly relative to the prior art, no additions to the heater element are required. Thus, no additional firings of the heater element materials are required. In other words, once the heater element is fired and the operating characteristics established, this invention merely contemplates removal of unnecessary material which does not alter the characteristics of the remaining materials, per se, which can occur as a result of multi-firings necessary to first render the heater element conductive and then render the additive portion conductive. Moreover, instant feedback on the resistance of the heater element is obtainable.

In operating the gas discharge display, it is desirable that a warm-up period precede the start up of the display in a cold environment. To ensure proper heating, a thermostat control (not shown) can be used in conjunction with the heater element. A thermostat sensor may be placed in or on or near the display unit 10 to provide temperature information to the electronic control.

Of course, it should be understood that various changes and modifications to the preferred embodiment described above will be apparent to those skilled in the art. For example, a variety of configurations for the heater element and the cathode display terminal are possible. However, these and other changes which fall within the purview of this description are intended to be included therein as well. The scope of the invention is not to be limited by this description but, rather, only by the scope of the claims appended hereto.

We claim:

1. In a gas discharge display device having a cathode terminal and an anode terminal separated from each other within a sealed gas chamber formed between two layers of glass, the gas in the chamber including a mixture of inert gas and mercury at sub-atmospheric pressure, the improvement comprising:

heater means on one of said layers of glass positioned proximate to and co-planar with the cathode terminals within the chamber in said display device for selectively maintaining an appropriate temperature within said display device so that mercury is maintained in a gaseous state within said display device;

said heater means including trim portions thereof which may be selectively removed in order to alter the characteristics of said heater means;

insulating means intermediate said two layers of glass and including apertures overlying said trim portions of said heater means and said cathode terminals;

said insulating means electrically insulating said heater means from said cathode terminals and from said anode terminal and operative to facilitate the conduction of heat from said heater means to said gas in said chamber; and sealing means disposed around the periphery of said display device;

said sealing means arranged to replace the trim portions of said heater means which have been selectively removed in order to prevent electrical interconnection thereof.

2. The gas discharge display device recited in claim 1 further comprising, a plurality of electrically conductive connectors extending in parallel from one edge of said display device to provide an electrical connection for said cathode terminals, said anode terminal and said heater means.

3. The gas discharge display device recited in claim 1 further comprising, two layers of glass sealed together to form the gas chamber, said heater means being located between said layers of glass.

4. The gas discharge display device recited in claim 1 wherein, said heater means and said cathode terminals are fabricated of the same material.

5. The gas discharge display device recited in claim 1 wherein, said appropriate temperature is higher than 0° C.

6. The gas discharge device recited in claim 1 wherein, said insulating means electrically insulates said heater means from said gas in said chamber so that the heater means does not affect the light discharge between said anode and cathode terminals.

7. A gas discharge display device comprising, a sealed chamber formed between two co-extensive layers of glass and containing a mixture of an inert gas and mercury at a sub-atmospheric pressure;

a cathode terminal formed of a conductive nickel material at one side of said chamber and shaped to provide means for displaying alpha-numeric images;

an anode terminal formed of a transparent layer of indium tin oxide (ITO) located at the opposite side of said chamber from said cathode terminal;

a heater element formed of said conductive nickel material proximate to and co-planar with said cathode terminal within said chamber for maintaining an appropriate internal temperature so that mercury within the chamber is maintained in a gaseous state;

said heater element including at least a plurality of parallel runs which are connected together at multiple locations by selectively severable links;

said heater element comprising a plurality of convolutions which meander around said cathode terminal to selectively supply heat to all portions of said display device;

common insulating means comprising a dielectric layer of glass at least portions of which are opaque overlying said heater element and said cathode terminal for electrically insulating said heater element from said cathode terminal and for electrically insulating said heater element from the gas in said chamber so that said heater element does not affect the light pattern produced between said anode terminal and said cathode terminal;

said common insulating means having apertures therethrough which are aligned with said severable links of said heater element and said cathode terminal;

means for providing an electrical connection to each of said cathode terminal, said anode terminal and said heater element, respectively; and a plurality of electrically conductive pins extending in parallel, outwardly from one edge of said device.

8. A gas discharge display device comprising, a sealed chamber formed between two layers of glass containing at least one inert gas and mercury at a sub-atmospheric pressure;

cathode terminal means at one side of said chamber shaped to include means for displaying alphanumeric images;

anode terminal means located at the other side of said chamber and aligned with said cathode terminal means;

heater element means proximate to and co-planar with said cathode terminal means within said chamber for maintaining an appropriate temperature within said chamber so that mercury within the chamber is maintained in a gaseous state;

heater element links which are adapted to be selectively removed to alter the operating characteristics of said heater element means;

common insulating means overlying said heater element means and said cathode terminal for electrically insulating said heater element means from said cathode terminal and for electrically insulating said heater element means from the gas in said chamber so that said heater element means does not affect the light pattern between said anode terminal and said cathode terminal;

said common insulating means including apertures therethrough which are aligned with said heater element links and said cathode terminal means; and adhering means for joining together said two layers of glass and adapted to replace any of said heater element links which have been removed to prevent reconnection therebetween by said mercury in the event of a condensation thereof.

9. The gas discharge display device recited in claim 8 including, means for providing an electrical connection to each of said cathode terminal, said anode terminal and said heater element means.

10. The gas discharge display device recited in claim 9 wherein, said means for providing an electrical connection comprises a plurality of electrically conductive pins extending in parallel from one edge of said device.

* * * * *